US005695084A

United States Patent [19]

Chmela et al.

[11] Patent Number: 5,695,084

[45] Date of Patent: Dec. 9, 1997

[54] DISPOSABLE ONE-PIECE CONTAINER CLOSURE AND EATING UTENSIL

[76] Inventors: John F. Chmela; James Chmela, both of 1106 Beechwood Dr., Mt. Prospect, Ill. 60056

[21] Appl. No.: 698,770

[22] Filed: Aug. 16, 1996

Related U.S. Application Data

[63] Continuation of Ser. No. 334,553, Nov. 4, 1994, abandoned.

[51] Int. Cl.[6] ..... B65D 51/26

[52] U.S. Cl. ..... 220/212; 206/541; 215/228; 220/780; 220/796; 229/125.03

[58] Field of Search ..... 215/228; 229/125.03; 206/541; 220/212, 735, 521, 268, 780, 796

[56] References Cited

U.S. PATENT DOCUMENTS

| | | | |
|---|---|---|---|
| 1,172,122 | 2/1916 | Englund | 229/125.03 X |
| 1,324,682 | 12/1919 | McIntyre | 229/125.03 X |
| 1,598,524 | 8/1926 | Holdsworth | 220/735 X |
| 1,625,335 | 4/1927 | Schneider | 229/125.03 X |
| 2,598,987 | 6/1952 | Franzen | 229/125.03 X |
| 3,208,625 | 9/1965 | Trabacchi | 220/735 X |
| 3,804,282 | 4/1974 | Komendowski | 215/228 X |
| 3,955,742 | 5/1976 | Marshall et al. | 220/735 X |
| 4,036,398 | 7/1977 | Hoogvelt et al. | 220/735 X |
| 4,060,176 | 11/1977 | Tobiasson | 215/228 X |
| 4,393,988 | 7/1983 | Burke | 229/125.03 |
| 4,930,637 | 6/1990 | De Roseau | 220/521 X |
| 5,188,234 | 2/1993 | Fukuda et al. | 206/541 |
| 5,261,560 | 11/1993 | Wang | 220/212 X |

*Primary Examiner*—Allan N. Shoap
*Assistant Examiner*—Robin A. Hylton
*Attorney, Agent, or Firm*—Stein, Pendorf & Van Der Wall

[57] ABSTRACT

A single piece container closure and eating utensil wherein a container closure and an eating utensil of relatively conventional design are joined by a thin living hinge, such that the eating utensil can be easily folded under the container closure and be retained enclosed between the container closure and the covered container containing the food product prior to use. The container closure/eating utensil assembly can be fitted to standard commercial containers, the eating utensil is protected against contaminants prior to use, and the eating utensil is immediately available for use in a clean and sanitary condition as the consumer opens the container.

7 Claims, 2 Drawing Sheets

DISPOSABLE ONE-PIECE CONTAINER CLOSURE AND EATING UTENSIL

This is a continuation of application Ser. No. 08/334,553 filed Nov. 4, 1994, now abandoned entitled "DISPOSABLE ONE-PIECE CONTAINER CLOSURE AND EATING UTENSIL".

BACKGROUND OF THE INVENTION

1. Field of the Invention

The present invention concerns a container closure such as a lid which is particularly suitable for use with containers of the type used for single servings of food products such as yogurt or fruit cocktails. The container closure and an integral detachable eating utensil are formed as a unitary structure.

2. Description of the Related Art

It has been popular to sell food in small, single-serving containers so that consumers may take ready-to-eat prepackaged food to the office rather than packing a lunch. Recently, rather than carrying food from home to the office, or as an alternative to fast-food restaurants, it has become increasingly popular for office employees to visit grocery stores during lunch and to buy small containers of food, such as yogurt or fruit, for immediate consumption. This type of food can only be eaten with a spoon or fork. Realizing that the consumer desires to buy such products which can only be eaten if the consumer is in the possession of an eating utensil such as a spoon, merchants have found it necessary to provide the consumer with the necessary eating utensil. The provision of such eating utensils to the consumer entails both a cost factor and a nuisance factor to the merchant.

Attempts have been made to overcoming these problems by integrating, e.g., a spoon, into the container closure of the food container. This way there is always a direct one-to-one correspondence of container closures to spoons, the consumer is not tempted to take more spoons than the number to which he is entitled, and the cost of the spoon is usually less than the cost of independently provided spoons.

For example, U.S. Pat. No. 4,393,988 (Burke) teaches a lid including a separate flap which can be folded out, so that the flap can serve as the spoon bowl and the lid as the spoon handle. The material is resilient, so that the lid can return to its original shape for resealing the container between servings. However, if this lid has been contaminated, the spoon is also contaminated. The lid is unnatural in appearance, and since it is resilient, cannot be released once eating has commenced, otherwise it must be reshaped, which may be messy if food products have adhered to the spoon.

U.S. Pat. No. 4,060,176 (Tobiasson) teaches a container lid which is semi-perforated so that the lid can be converted into a spoon portion and a handle portion. However, in addition to the contamination problem, it is necessary to educate the consumer as to the technique for converting this lid into a spoon, and the spoon does not have a natural appearance or feel.

U.S. Pat. No. 4,218,010 (Ruff) teaches a container lid which is convertible into a spoon by bending the sides in towards each other. This spoon-lid suffers from the same problems mentioned above.

United States Design Patent 302,793 (Yamaguchi) teaches a lid including a spoon integrally formed with the lid. However, the spoon is not detachable, and is in contact with the food during shipment. This design is expensive to manufacture and distribute to packagers due to the large amount of space taken up by each lid and the poor stackability. The spoon cannot be inserted into containers containing bulky foods such as fruit cocktails.

U.S. Pat. No. 3,550,805 teaches a lid in which a removable "closure member" can be used as a spoon. Since the spoon must satisfy the function of a "closure member" it cannot be designed as a relatively shallow spoon as customarily used for eating ice cream or yogurt. Further, the spoon and lid are not die cast as a single item. Finally, the spoon is disclosed as being useful for measuring, but is not disclosed as being useful for eating.

There is a need for a system for delivery of eating utensils as a part of the packaging of the type of readily consumable food products requiring an eating utensil such as a spoon or fork, which eating utensils are made of a composition which has a good "mouth feel", which is relatively sturdy, and which is compatible with the food product.

SUMMARY OF THE INVENTION

The invention thus has the objective of providing a container closure having an eating utensil incorporated therein, wherein the eating utensil is protected against contaminants prior to use, and wherein the eating utensil is not in contact with the food prior to consumption, so that the eating utensil is immediately available for use in a clean and sanitary condition as the consumer opens the container.

It is a further object of the invention to provide a single serving food container which eliminates the need for the merchant to separately provide an eating utensil.

Further yet, it is an object of the invention to provide with a single serving food container an eating utensil which has a conventional appearance, retains its shape during use, is comfortable in the hand of the user, and has a good mouth-feel.

It is yet a further object of the invention to provide a container closure/eating utensil assembly which can be made of a single piece of material at the same time, which can be fitted to standard commercial containers, and which can be manufactured with only minor modifications of the conventional container closure manufacturing processes.

It is still another object of this invention to provide a container closure/eating utensil assembly for use with a container that is simple in design and economical to manufacture.

It is still another object of this invention to provide a molded plastic closure assembly for use with a molded plastic container.

These objects are solved in accordance with the present invention by the forming of a single piece container closure and eating utensil wherein a container closure and an eating utensil of relatively conventional design are joined by a thin living hinge, such that the eating utensil can be easily folded under the container closure and be retained enclosed between the container closure and the covered container containing the food product prior to use.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other container closure assemblies for carrying out the same purposes of the present invention. It should also be realized by those skilled in the art that such equivalent structures do not depart from the spirit and scope of the invention as set forth in the appended claims.

BRIEF DESCRIPTION OF THE DRAWING

For a fuller understanding of the nature and objects of the present invention reference should be made to the following detailed description taken in with the accompanying drawings wherein.

DETAILED DESCRIPTION OF THE INVENTION

A feature of the invention is the manufacture of a single piece container closure and eating utensil assembly, wherein the eating utensil such as a spoon is easily folded into the storage position via a resilient hinge for storage between the lid of the container closure and the food product. One end of the spoon is hinged to the edge of the container closure by a resilient or living hinge, and the spoon is folded under the container closure without detaching. The hinge is designed to permit easy detachment of the spoon from the container closure.

The present invention relates to a container closure which may be provided with any ready-to-eat, single service food container, such as containers of fruit cocktail, pudding, and foods which are hot packed, retorted or intended to be microwaved in the container and including vegetables, meat products, soups and other processed foods, and even containers of ancillary food products such as cake icing. Although it will be readily understood that the invention has broad applications, the invention will be described using a yogurt container as an illustrative embodiment.

Yogurt is usually provided in a container having a strong floor and walls, the container being sealed across the top with a thin metal or plastic foil. The container closure of the present invention, with the spoon in the stored position, is placed on the top of the container, over the foil seal. In use, the container closure is removed, the spoon is folded out and detached, the foil is removed from the container, and the contents of the container are consumed. If the entire contents of the container are not consumed, the container closure can be used to reseal the container.

The container closure may be round, oval, square, or any shape necessary for engaging the top of a food container.

A preferred embodiment of the present invention will now be described in greater detail by reference to the drawings.

The unitary container closure and eating utensil combination is comprised of a container closure 1 and an eating utensil 2 joined by a resilient hinge, such as a "living" hinge 3. Such a resilient or "living" hinge is preferably integrally molded with the lid and closure body, and enables the spoon to be pivoted from the closed or storage position shown in FIG. 3 to the open or detaching position shown in FIGS. 1 and 2. The "living" hinges are only a few thousandths of an inch in thickness, and are preferably notched with a slight nick or incision on either side to facilitate the tearing off of the eating utensil from the container closure.

Figure 1:
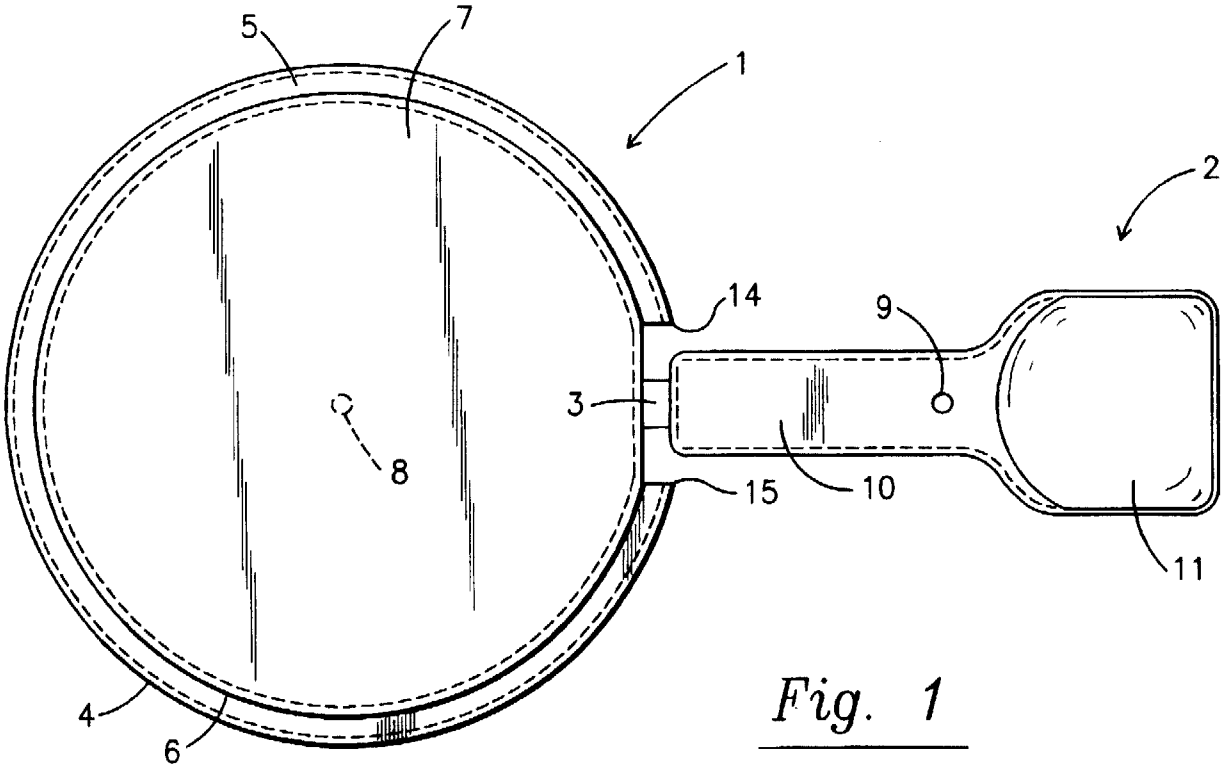
FIG. 1 is a top view of one embodiment of the container closure according to the present invention.
Figure 2:
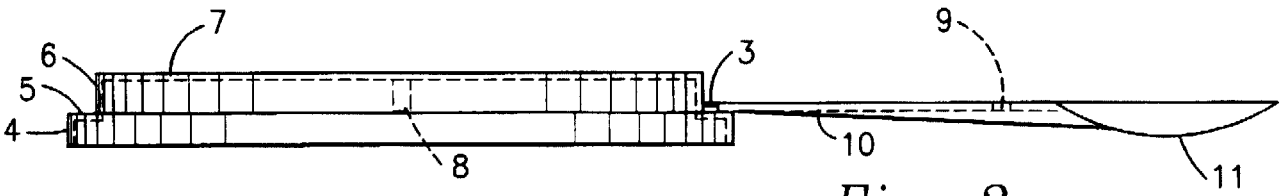
FIG. 2 is a side view of the embodiment of FIG. 1.

The form stability of the container closure as show in FIG. 1 is enhanced by the step-shaped outer rim portion, comprising an outer rim 4, an inner rim 6, a flat brim 5 between the inner and outer rims, and round, flat lid 7 which extends across the top of the container closure and is coplanar with flat brim 5. In the embodiment shown in the figures, the outer rim 4 and the flat brim 5 extend approximately 345° about the container closure, leaving a gap so that the eating utensil, which is attached to the inner rim 6, can be folded under the flat lid 7.

Eating utensil 2 may be a knife, a fork, or a spoon, and in the embodiment shown in the figures the eating utensil is a spoon comprising a stem part 10 and a bowl part 11. The bowl part is so dimensioned as to fit completely into the recess in the container closure 1 defined by the flat lid 7 and the inner rim 6.

The flat lid 7 is preferably but not necessarily provided with a short knob or projection 8 which serves to releasably engage the eating utensil 2 via aperture 9 of the eating utensil when the eating utensil 2 is folded into the storage position, i.e., into the recess defined by the flat lid 7 and the inner rim 6.

Container 13 is preferably injection molded from a durable plastic material, preferably a plastic material which has received U.S. Food and Drug Administration approval for use in connection with food. One suitable plastic material is polypropylene but other polyolefins may be used, such as a high density polyethylene copolymer, HiD 9118, sold by Chevron, or the like. One advantage of using plastic material is that the container will not rust. The container body may include a wholly different polymer than the container closure or may include different ingredients such as flow or slip aids in a similar polymer. However, any suitable material may be used for the container 13 including glass, metal, or the like. The container body may also include composite constructions including paper, metal films or other materials.

Figure 3:
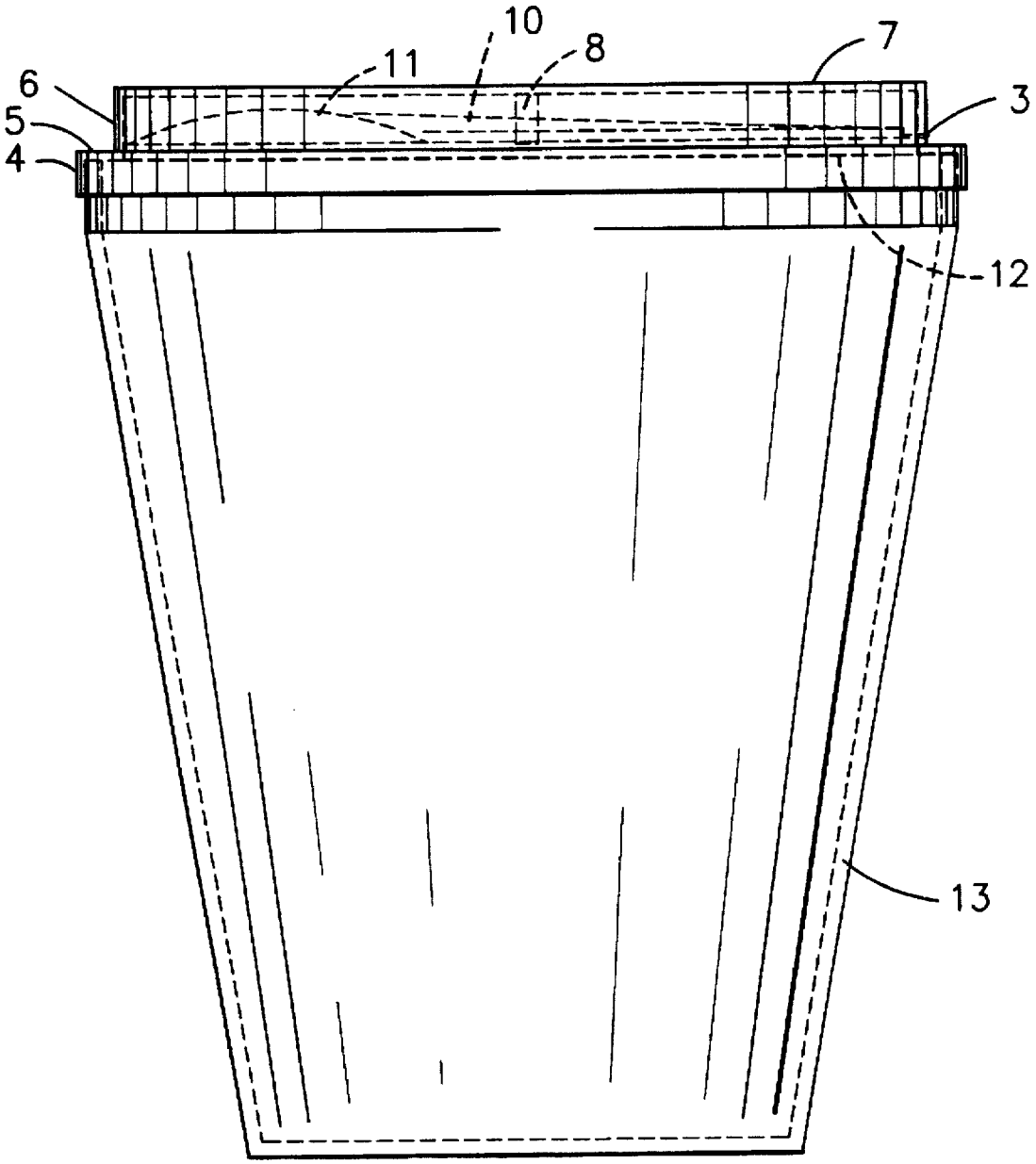
FIG. 3 is a side view showing the container closure and eating utensil assembled on a food container.

As show in FIG. 3, food is sealed in container 13 by means of a thin strippable layer of a metal or plastic foil 12. The thin strippable layer keeps the container closed and imparts form stability during the removal of the container closure. The strippable layer is adhered to the lid in a relatively weak fashion so that it can be removed without damaging the container.

Not all plastics are adequate oxygen barriers. The foil is preferably a highly crystalline oriented PET, but any other suitable barrier material may be used, such as EVOH, etc., preferably being selected to be readily recyclable together with the container. Other barrier materials such as PVDC are not favored because they are not compatible for recycling with the preferred plastics suitable for such containers. If desired, the foil material can consist of a plurality of layers, each exhibiting a certain desired property, such as barrier properties for oxygen, carbon-dioxide, water vapor and the like, mechanical resistance, etcetera. Printing patterns may be applied to the inner side surface of a transparent type of plastic, or to the top of a foil material.

When the eating utensil 2 is folded into the storage position, the eating utensil does not extend down below the plane defined by the flat brim portion 5, and thus does not break the plane occupied by the foil 12.

Outer rim 4 is dimensioned to frictionally engage with the upper annulus of the container 13. The container closure is intended to be used to reseal the container for preservation of the contents if the entire contents of the container are not utilized. The manner of engagement of the container and the container closure is not limited, and examples of container closures with various engagement mechanisms can be seen in U.S. Pat. Nos. 3,223,278, 4,296,871, 4,397,404, 4,619, 373, 4,955,504, 4,699,290, 4,741,450, 4,130,218, 5,205,430 and 5,271,536. However, a simple frictional contacting is considered sufficient for most purposes.

The container closure preferably has a thickness of from 10 to 15 mills.

It is possible to make the container closure by a thermoforming process, i.e., stamping a heated synthetic polymer sheet of material (e.g., a vinyl such as polyvinyl chloride, a styrene such as high impact polystyrene, an acrylic, an olefin, etc.), drawing it to a desired shape, and allowing the deformed material to cool.

However, it is more preferable to make the container closure by an injection molding process. Molded plastic container closures can be molded at high production rates and with close tolerances, and have met with widespread commercial acceptance.

The injection moldable thermoplastic composition which can be used to form the container closure and eating utensil of the present invention is not particularly limited and it is well within the skill of those in the art to select polymers, modifiers and additives to produce compositions tailored to a particular use. Preferably, the container closure 1 is injection molded from a durable plastic material such as a high density polyethylene copolymer, but may be any of polyolefins, such as polypropylene and polyethylene, polyethylene terephthalate, polystyrene, acrylonitrilestyrene-butadiene polymer, nylon, acetal polymer, polycarbonate, nitrile resins, polyvinyl chloride, polysulfone and other semi-rigid to rigid polymers including multipolymers, polymer blends and polymer laminar constructions thereof having enhanced properties such as barrier to gases, heat resistance, etc.

The container closure is preferably molded in the opened position. After molding, the eating utensil portion is folded under, usually while the plastic remains at an elevated temperature.

As one possible composition which can be used in the present invention, see U.S. Pat. No. 5,278,233 which discloses a thermoplastic resin composition indicated as exhibiting excellent processability into molded articles, films and sheets by injection molding, extrusion molding, etc, and can give products which have well-balanced properties among stiffness, heat resistance, impact resistance, scratch resistance, coatability, oil resistance, chemical resistance, water resistance, etc., and which are excellent in appearance uniformity and smoothness. The thermoplastic resin composition comprises:

(1) a resin composition consisting of (i) at least one member selected from the group consisting of (a) a modified polypropylene to which has been graft copolymerized an unsaturated carboxylic acid or the derivative thereof, (b) a modified polypropylene to which have been graft comodified an unsaturated aromatic monomer and either an unsaturated carboxylic acid or the derivative thereof, (c) a mixture of the modified polypropylene (a) and a polypropylene, (d) a mixture of the modified polypropylene (b) and a polypropylene, (e) a modified mixture of a polypropylene and a rubbery substance to which mixture has been graft copolymerized an unsaturated carboxylic acid or the derivative thereof, (f) a modified mixture of a polypropylene and a rubbery substance to which mixture have been graft copolymerized an unsaturated aromatic monomer and either an unsaturated carboxylic acid or the derivative thereof, (g) a mixture of the modified mixture (e) and a polypropylene, and (h) a mixture of the modified mixture (f) and a polypropylene, and (ii) a thermoplastic copolymer containing acid anhydride moiety of a six-membered ring, and (2) an epoxy group-containing copolymer.

Further thermoplastic compositions and injection molding techniques which can be adapted to the present invention are set forth in, e.g., U.S. Pat. Nos. 5,250,621, 5,095,063, 5,218,046, 5,196,482, 5,174,932, 5,169,648, 5,160,687, 5,149,547, 5,247,779 and 5,140,065.

Thermoplastic containers and methods of manufacturing them are disclosed in, e.g., U.S. Pat. Nos. 5,062,568, 5,026,338, 4,991,734, 4,983,238, 4,962,862, 4,933,135, 4,919,742, 4,911,772, 4,856,664, 4,840,555, 4,830,215, 4,811,550, 4,717,523, 4,717,522, 4,706,833, 4,704,243, 4,690,295, 4,650,628, 4,641,758, 4,494,679, 4,463,056, 4,229,929, 4,197,958, 4,177,932, 4,172,534, and 4,101,047.

In the case that it is desired to provide tamper resistance in the container, a heat-shrink tamper-evident plastic gas permeation barrier may be provided around the periphery of the container, contacting both the container walls and the container closure.

Although the system was first designed for providing eating utensils with ready-to-eat foods, it will be readily apparent that the system is capable of application to related articles such as containers of cake icing, containers of paint dye, etc. and is thus capable of use in a number of other applications. Although this invention has been described in its preferred form with a certain degree of particularity with respect to a container for yogurt, it is understood that the present disclosure of the preferred form has been made only by way of example and that numerous changes in the details of structures and the composition of the system may be resorted to without departing from the spirit and scope of the invention.

Now that the invention has been described,

What is claimed is:

1. An injection molded container closure comprising:

a lid having a substantially planar top and a rim portion adapted for engagement with a container said rim portion having means for engaging a top, outer periphery of the container when in a closed position; and an integrally formed, detachable eating utensil, wherein said eating utensil is joined to the rim portion of said lid by means of a severable resilient hinge such that said eating utensil can be folded underneath said lid to cover said eating utensil prior to use, and said lid remains intact and reusable for engagement with a container after said eating utensil is detached.

2. An injection molded container closure as in claim 1, wherein said eating utensil is provided with an aperture, and said lid is provided with a projection adapted for releasable engagement with said aperture of said eating utensil when said eating utensil is folded at said hinge under said lid.

3. An injection molded container closure as in claim 1, wherein said eating utensil is a spoon.

4. An injection molded container closure as in claim 1, wherein said container closure is formed of a material selected from the group consisting of a high density polyethylene copolymer, polypropylene, polyethylene, polyethylene terephthalate, polystyrene, an acrylonitrilestyrene-butadiene polymer, nylon, acetal polymer, polycarbonate, nitrile resins, polyvinyl chloride, polysulfone and other semi-rigid to rigid polymers including multipolymers, polymer blends and polymer laminar constructions thereof.

5. An injection molded container closure as in claim 1, wherein said container closure is formed of a material selected from the group consisting of polypropylene, polyethylene, and polyethylene terephthalate.

6. An injection molded container closure as in claim 1, wherein said eating utensil has at least one longitudinal end, and wherein said living hinge connects said longitudinal end of said eating utensil to said rim of said lid of said container closure.

7. A one piece injection molded combination eating utensil and container closure comprising:

a lid having a substantially planar top and a rim portion adapted for engagement with a container said rim portion having means for engaging a top, outer periphery of the container when in a closed position; and an integrally formed, detachable elongate eating utensil having an end for engagement with food and an opposite end, wherein said end of said eating utensil opposite said food engaging end is joined to the rim portion of said lid by means of a severable resilient hinge such that said eating utensil can be folded underneath said lid and hidden from view prior to use when said lid is engaged with said container, and wherein said lid remains intact and reusable for sealing engagement with said container after said eating utensil is detached.

* * * * *